United States Patent [19]

Duintjer

[11] 4,378,608

[45] Apr. 5, 1983

[54] APPARATUS FOR COVERING A LIQUID BASIN, AND ROLLER-BLIND TYPE COVER FOR USE THEREIN

[76] Inventor: Engbert J. Duintjer, Rolderstraat 13, 9531 TC Borger, Netherlands

[21] Appl. No.: 210,607

[22] Filed: Nov. 26, 1980

[51] Int. Cl.[3] ..... E04H 3/16; E04H 3/18

[52] U.S. Cl. ..... 4/500; 4/502

[58] Field of Search ..... 4/498, 502, 500, 501

[56] References Cited

U.S. PATENT DOCUMENTS 2,958,083 11/1960 Shook et al. ..... 4/502

3,144,665 8/1964 Meyer ..... 4/502

3,613,126 10/1971 Granderath ..... 4/502

*Primary Examiner*—Henry K. Artis

*Attorney, Agent, or Firm*—Scully, Scott, Murphy & Presser

[57] ABSTRACT

Apparatus for covering a liquid basin, such as a swimming pool. The apparatus comprises a roller-blind type cover assembled from hollow slats arranged to be spread over the surface of the liquid. According to the invention the cover is constructed so as to be stackable accordion-wise by the side of a shaft or roller with which the cover is spread over the surface of the liquid or withdrawn from it, thereby to reduce weight on said shaft or roller compared with a prior construction in which the cover is wound upon the shaft.

4 Claims, 3 Drawing Figures

Figure 1:
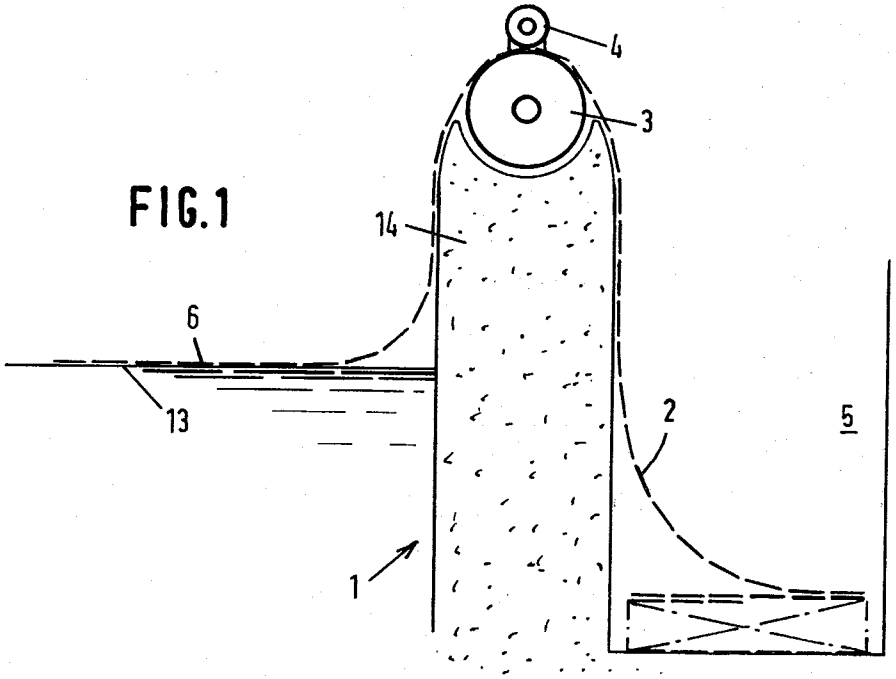

APPARATUS FOR COVERING A LIQUID BASIN, AND ROLLER-BLIND TYPE COVER FOR USE THEREIN

This invention relates to apparatus for covering a liquid basin, in particular a swimming-pool, the apparatus being arranged outside the liquid basin, and comprising a roller-blind type cover composed of hollow, elongated slats arranged to be spread over the surface of the liquid in floating condition, and to be removed from said surface.

Apparatus of this kind is described in German Published Patent Application No. 1,434,647. In the apparatus described in the German application, when not in use the roller-blind type cover is wound on a shaft which can be rotated, for example, by means of a motor. The shaft is mounted in a pedestal, which in turn is installed either on the bottom of the basin, such as a swimming pool, or outside it on the rim of the basin. In these arrangements it is ensured in both cases that the perpendicular distance of the rotatable shaft from the liquid surface is selected so that under the influence of the vertical component of the difference in weight between the still wound-up portion of the cover and the unwound portion thereof the shaft is subjected to such a turning moment that the cover is decoiled on its own. For re-coiling the cover mechanical means are provided for rotating the shaft, either hand-operated or by motor.

As the rotatable shaft must be capable of carrying the entire weight of the roller-blind cover, it must necessarily be of relatively heavy construction, in particular in the case of a large swimming pool, for example, 50 meters long.

It is accordingly an object of the present invention to provide an apparatus of the above kind in which the apparatus, or any part thereof, need not carry the entire weight of the cover.

For this purpose, according to the present invention, the roller-blind type cover is constructed so as to be stackable accordion-wise.

In one embodiment of the present invention, one longitudinal edge of each of the slats is provided with a moulding of a first type, and the other longitudinal edge is provided with a moulding of a second type, the slats being assembled to form a roller-blind type to cover in a pattern in which, in each adjacent pair of slats, the longitudinal edge with the moulding of the first type of one slat is slid into the moulding of the second type of the longitudinal edge of the other slat to form a slide connection permitting a hinge effect which, in each adjacent pair of slats, includes an angle of at least approximately 90° in the direction of one of the sides of the spread roller-blind type cover, and includes a considerably smaller angle than 90° towards the other side, and further characterized in that the cover is assembled from a plurality of packets of slats, each packet comprising a plurality of slats in which, in one packet, in each pair of adjacent slats, the hinge effect includes the angle of at least approximately 90°, relative to the spread cover, towards one side thereof, and in the adjacent packet of slats towards the other side thereof, the adjacent packets of slats being interconnected by means of an elongated coupling member having moulded longitudinal edges, one longitudinal edge of which coupling member is slid into the moulding of the first type of the longitudinal edge belonging to the end slat of one packet of slats, and the other longitudinal edge of which coupling member is slid into the moulding of the second type of the longitudinal edge belonging to the initial slat of the adjacent packet of slats to form a coupling which, relative to the spread roller-blind type cover, has a hinge effect including an angle of substantially 180° for the accordion-wise stacking of the cover.

Preferably the number of slats per packet of slats is equal, so that the pleats of the roller-blind type cover, formed when the cover is stacked accordion-wise, are equally broad.

A highly advantageous embodiment of the apparatus according to the present invention is one in which the apparatus comprises a horizontal rotatable shaft, preferably arranged to be driven by a motor, via which shaft the roller-blind type cover can be transported to and from the liquid surface in the liquid basin while being supported in the longitudinal direction of the slats thereof by the circumferential surface of the shaft, the apparatus being further characterized in that the rotatable shaft is formed as a supporting roller with a non-slip surface and is combined with a superimposed compression roller to form a roller pair defining a nip between them through which the roller-blind type cover is passed, and can be transported to and from the liquid surface under the influence of the rotating supporting roller.

Owing to the fact that during the spreading over the surface of the liquid, and also during the removal therefrom, the cover hangs freely on opposite sides of the supporting roller over a limited height only, this means a great saving in weight for the supporting roller relative to the condition in which the cover is wound on the supporting roller.

The invention also relates to a roller-blind type cover suitable for use in the apparatus according to the invention.

Figure 2:
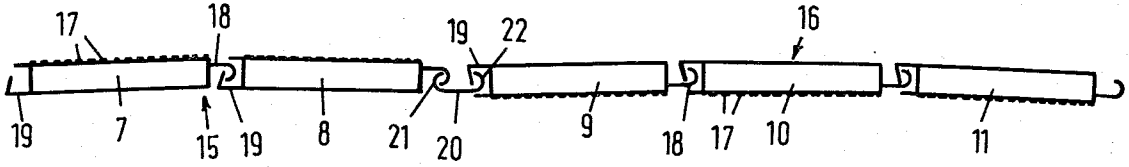
Figure 3:
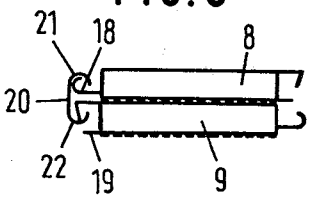

One embodiment of the invention will now be described, by way of example, with reference to the accompanying drawings, in which FIG. 1 is a diagrammatic side-elevational view, showing the apparatus according to the invention in a condition in which a portion of the cover is spread out over the surface of the liquid, and a portion is still folded accordion-wise in the stacked condition;

FIG. 2 is a diagrammatic side-elevational view, showing a portion of the cover comprising parts of two adjacent packets of slats; and FIG. 3 is a diagrammatic elevational view, showing the end slat of one packet of slats as shown in FIG. 2 and the initial slat of the adjacent packet of slats, interconnected by a coupling member, and in the folded state for being stacked accordion-wise.

Referring to the drawings, there is shown an apparatus according to the present invention, generally designated by 1, and comprising a roller-blind type cover 2, a supporting roller 3 forming a pair of rollers with a compression roller 4, which may be a divided roller, and a trough-shaped container 5.

Portion 6 of the cover is spread out over the surface of a liquid, for example, water 13 in a swimming pool, of which 14 designates the rim.

The width of container 5 has been selected so that it is not much in excess of the width of a packet of slats.

The surface of supporting roller 3 has been rendered non-skid or non-slip, by being covered with a non-slip material, for example, neoprene cellular rubber. Supporting roller 3 is rotatable clockwise and counterclockwise by means of a motor not shown, which through a drive gear is operatively associated with supporting roller 3.

Cover 2 is assembled from a plurality of packets of slats. In FIG. 2, 15 designates a portion of one packet of slats of a pair of adjacent packets, and 16 designates a portion of the adjacent packet of slats, 7 and 8 being slats of packet 15 and 9, 10 and 11 being slats of the adjacent packet 16.

Corresponding sides of the slats are marked by dots 17.

The longitudinal edges of the slats are respectively provided with mouldings of a first and a second type, as designated by 18 and 19 of slat 7. As best shown in FIG. 2, the slide connection of the co-operating mouldings 18 and 19 leads to a hinge effect which for slats 7 and 8 in FIG. 2 is possible over a small angle only in the upward direction, as viewed in FIG. 2, and over a large angle of up to approximately 90° in the opposite direction, i.e., downwardly in FIG. 2.

It can be seen from the markings with dots 17 that slats 9, 10, and 11 of packet 16 are turned upside down as compared with the slats of packet 15, so that the hinge effect between slats 9, 10 and 11 includes the large angle of up to approximately 90° in the upward direction, as viewed in FIG. 2 and accordingly includes the small angle downwards.

Packets of slats 15 and 16 are coupled together by means of a coupling member 20, which is channel-shaped with walls 21 and 22 curved towards one another. FIG. 3 shows that coupling member 20 co-operates with mouldings 18 and 19 belonging to the longitudinal edges of each slat to make possible a hinge effect through an angle of 180°.

In summary, the following advantages of the apparatus according to the present invention can be mentioned:

1. The shaft construction may be relatively light, as the weight of the non-spread portion of the cover rests on the rotatable supporting roller as to a very minor part only;

2. The shaft can be journalled at a plurality of places, unlike the prior system, in which the cover is wound on the shaft so that the shaft must be journalled at its extremities;

3. The apparatus is not excluded from being arranged either on the short or the long side of a rectangular liquid basin.

Naturally the apparatus and the roller-blind type cover according to the invention as described herein and shown in the accompanying drawings may be modified without departing from the scope of the invention.

What I claim is:

1. Apparatus for covering a liquid basin, in particular a swimming pool, the apparatus being arranged outside the liquid basin, comprising a roller-blind type cover composed of hollow, elongated slats arranged to be spread over the surface of the liquid in floating condition, and to be removed from said surface wherein the longitudinal edge of each of the elongated slats is provided with a moulding of a first type, and the other longitudinal edge is provided with a moulding of a second type, the slats being assembled to form a roller-blind type cover in a pattern in which, in each adjacent pair of slats, the longitudinal edge with the moulding of the first type of one slat is slid into the moulding of the second type of the longitudinal edge of the other slat to form a slide connection permitting a hinge effect which, in each adjacent pair of slats includes an angle of at least approximately 90° in the direction of one of the sides of the spread roller-blind type cover, and includes a considerably smaller angle than 90° towards the other side, and the cover is assembled from a plurality of packets of slats, each packet including a plurality of slats in which, in one packet, in each pair of adjacent slats, the hinge effect includes the angle of at least approximately 90°, relative to the spread cover, towards one side thereof, and in the adjacent packet of slats towards the other side thereof, the adjacent packets of slats being interconnected by means of an elongated coupling member having moulded longitudinal edges, one longitudinal edge of which coupling member is slid into the moulding of the first type of the longitudinal edge belonging to the end slat of one packet of slats, and the other longitudinal edge of which coupling member is slid into the moulding of the second type of the longitudinal edge belonging to the initial slat of the adjacent packet of slats to form a coupling which, relative to the spread roller-blind cover, has a hinge effect including an angle of substantially 180° to provide for an accordion-wise stacking of the cover upon retraction of said cover from the surface of the liquid in the liquid basin.

2. Apparatus according to claim 1, wherein the number of slats per packet of slats is equal.

3. Apparatus according to claim 1 which further comprises an enclosed compartment as a container for the storage of the accordion-wise stacked roller-blind type cover.

4. Apparatus for covering a liquid basin, in particular a swimming pool, the apparatus being arranged outside the liquid basin, comprising a roller-blind type cover composed of hollow, elongated slats arranged to be spread over and removed from the surface of the liquid in floating condition by a horizontal rotatable shaft, wherein the longitudinal edge of each of the slats is provided with a moulding of a first type, and the other longitudinal edge is provided with a moulding of a second type, the slats being assembled to form a roller-blind type cover in a pattern in which, in each adjacent pair of slats, the longitudinal edge with the moulding of the first type of one slat is slid into the moulding of the second type of the longitudinal edge of the other slat to form a slide connection permitting a hinge effect which, in each adjacent pair of slats includes an angle of at least approximately 90° in the direction of one of the sides of the spread roller-blind type cover, and includes a considerably smaller angle than 90° towards the other side, and the cover is assembled from a plurality of packets of slats, each packet including an equal number of slats in which, in one packet in each pair of adjacent slats, the hinge effect includes the angle of at least approximately 90°, relative to the spread cover, towards one side thereof, and in the adjacent packet of slats towards the other side thereof, the adjacent packets of slats being interconnected by means of an elongated coupling member having moulded longitudinal edges, one longitudinal edge of which coupling member is slid into the moulding of the first type of the longitudinal edge belonging to the end slat of one packet of slats, and the other longitudinal edge of which coupling member is slid into the moulding of the second type of the longitudinal edge belonging to the initial slat of the adjacent packet of slats to form a coupling which, relative to the spread roller-blind type cover, has a hinge effect including an angle of substantially 180° to provide for an accordion-wise stacking of the cover upon retraction of said cover from the surface of the liquid in the liquid basin, and wherein the rotatable shaft is driven by a motor and is formed as a supporting roller with a non-slip surface combined with a superimposed compression roller to form a roller pair defining a rip between them through which the roller-blind cover is passed and transported to and from the liquid surface.

* * * * *